United States Patent [19]

Abendroth

[11] Patent Number: 4,616,462

[45] Date of Patent: Oct. 14, 1986

[54] FASTENER FOR FLOORING SYSTEMS

[76] Inventor: Carl W. Abendroth, 210 Crystal Ave., Crystal Falls, Mich. 49920

[21] Appl. No.: 656,699

[22] Filed: Oct. 1, 1984

[51] Int. Cl.[4] ..... E04C 1/40; E04B 2/04

[52] U.S. Cl. ..... 52/509; 52/512; 52/714; 52/772; 52/779

[58] Field of Search ..... 52/509, 512, 714, 779, 52/489

[56] References Cited

U.S. PATENT DOCUMENTS

| | | | |
|---|---|---|---|
| 1,888,611 | 11/1932 | Wolfson | 52/512 |
| 1,889,138 | 11/1932 | Wolfson | 52/512 |
| 1,988,147 | 1/1935 | Voigt | 52/779 X |
| 2,317,428 | 4/1943 | Anderson | 52/714 X |
| 2,817,125 | 12/1957 | Johns | 52/512 |
| 2,831,222 | 4/1958 | Anderson | 20/92 |

FOREIGN PATENT DOCUMENTS

| | | | |
|---|---|---|---|
| 403261 | 12/1933 | United Kingdom | 52/512 |
| 697546 | 9/1953 | United Kingdom | 52/489 |

*Primary Examiner*—Alfred C. Perham

*Attorney, Agent, or Firm*—Michael, Best & Friedrich

[57] ABSTRACT

A flooring system comprising a foundation, a plurality of adjacent floorboards, each of the floorboards including a generally vertical side including a generally horizontal slot, and a base adjacent the foundation and including therein an opening spaced from the side, and clips for fastening the floorboards to the foundation, each including a generally horizontal upper portion received in the slot in the floorboard, a generally vertical portion, a lower generally horizontal base portion extending between the foundation and the base of the floorboard, and a projection extending upwardly in the base portion and spaced from the vertical portion and received in the opening in the base of the floorboard.

15 Claims, 4 Drawing Figures

FASTENER FOR FLOORING SYSTEMS

BACKGROUND OF THE INVENTION

This invention relates to flooring systems and, more particularly, to flooring systems including means interacting between a fastener and floorboards for effecting positive engagement between the floorboards and the fastener.

Attention is directed to Wolfson U.S. Pat. No. 1,889,138, issued Nov. 29, 1932, which discloses a T-shaped fastener for a flooring system, and Wolfson U.S. Pat. No. 1,888,611, issued Nov. 22, 1932, which discloses a T-shaped fastener for a flooring system, which fastener includes a base portion including a bend forming a hump in the base portion. As noted on page 2 of the U.S. Pat. No. 1,888,611 lines 16 through 21 and lines 65 through 69, the hump in the base portion is flattened when the fastener is secured to the floor foundation. Attention is also directed to Anderson U.S. Pat. No. 2,831,222, issued Apr. 22, 1958, which patent discloses fastening means including a horizontal portion including a bend forming a hump therein.

SUMMARY OF THE INVENTION

This invention provides a flooring system comprising a foundation, a plurality of adjacent floorboards, each of the floorboards including a generally vertical side including a generally horizontal slot, and a base adjacent the foundation and including therein an opening spaced from the side, and a plurality of clips, each including a generally horizontal upper portion received in the slot in the floorboard, a generally vertical portion, a lower generally horizontal base portion extending between the foundation and the base of the floorboard, and a projection extending outwardly on the base portion and received in the opening in the floorboard.

In one embodiment, each of the clips further includes means for fastening the clip to the foundation and comprising a fastener in the base portion of the clip, and the fastener includes a head projecting above the base portion of the clip and constituting the projection.

In one embodiment, the projection constitutes a bend in the base portion of the clip, which bend forms a vertically projecting hump which also extends generally parallel to the vertical portion of the clip. And the opening in the floorboard base comprises a groove extending generally parallel to the generally vertical side of the floorboard.

One of the principal features of the invention is the provision of a flooring system which includes floorboards and means for fastening the floorboards to the foundation, which means provides for positive engagement between the fastening means and the floorboards to help secure the floorboards in their proper positions.

Another of the principal features of the invention is the provision of means for fastening floorboards to a foundation, which means assists in the location of means for connecting the fastening means to the foundation.

Another of the principal features of the invention is the provision of such a flooring system which can be used to provide for little elevational gain or which can be used with a variety of underlayments.

Other features and advantages of the invention will become apparent upon review of the detailed description, the drawings and the appended claims.

Figure 2:
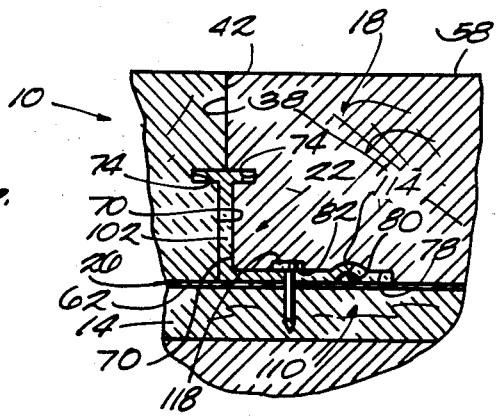
FIG. 2 is a cross-sectional view of the flooring system taken along the line 2—2 in FIG. 1.

Before explaining at least one embodiment of the invention in detail, it is to be understood that the invention is not limited in its application to the details of construction and the arrangement of components set forth in the following description or illustrated in the drawings. The invention is capable of other embodiments and of being practiced or carried out in various ways. Also, it is to be understood that the phraseology and terminology employed herein is for the purposes of description and should not be regarded as limiting.

DESCRIPTION OF THE PREFERRED EMBODIMENT

Figure 1:
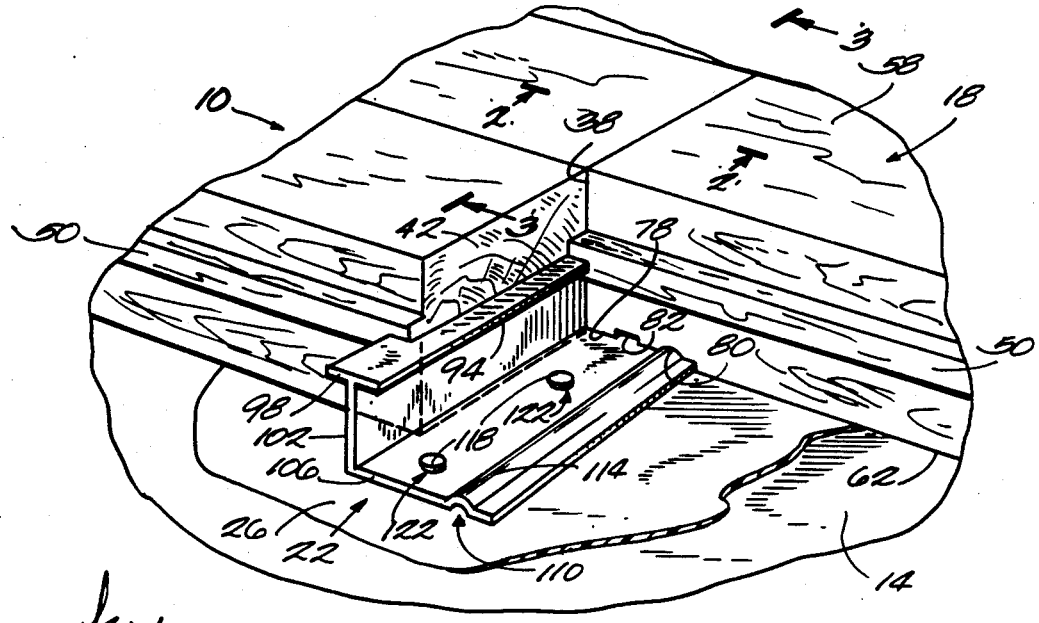
FIG. 1 is a partial perspective view of a portion of a flooring system which embodies various of the features of the invention.

With particular reference to the drawings, and more particularly in FIG. 1, a flooring system 10 is illustrated including a foundation or slab 14, a plurality of adjacent floorboards 18, and means 22 for fastening the floorboards 18 to the foundation 14.

The foundation 14 is a concrete subfloor which has been finished and leveled. Placed on top of the leveled slab is a vapor barrier 26 preferably made of six mil polyethylene with four inch lap joints covered with a melt membrane. In other embodiments, the foundation 14 can be an existing synthetic floor. Other types of vapor barriers 26 may also be used, such as two-ply asphalt saturated felt set in mastic.

The vapor barrier 26 may be overlayed with an underlayment (not shown) for cushioning and sound control, such as cork, compressed fill, or some other resilient material.

Although different materials of various sizes can be used, in this embodiment, the floorboards 18 are in the form of 25/32nds by 1½ inch hard maple flooring, with a uniform length of about twelve inches. The floorboards 18 are laid in end abutting courses of side-by-side floorboards 18 parallel with the long dimension of a room. Each of the floorboards 18 includes two spaced-apart generally vertical first and second sides 30 and 34, respectively (see FIG. 3), a front side or end 38 (see FIGS. 1 and 2), a rear side or end 42, and means 46 (see FIG. 3) for interlocking the adjacent first and second sides, 30 and 34, respectively, of different floorboards 38, said interlocking means 46 comprising a tongue 50 on the first side 30, and a groove 54 on the second side 34.

Each of the floorboards 18 also includes a top surface 58 and a bottom surface or base 62 which is laid adjacent the vapor barrier 26 on the foundation 14.

Figure 3:
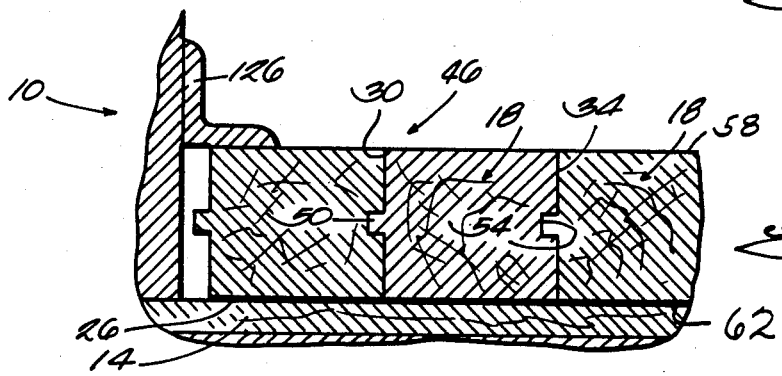
FIG. 3 is a cross-sectional view of the flooring system taken along the line 3—3 in FIG. 1.

As best illustrated in FIG. 2, each of the floorboards 18 also includes means for receiving the means 22 for fastening the floorboards 18 to the foundation 14, which receiving means comprises a generally vertical cutout 70, and a generally horizontal slot 74, which cutout 70 and slot 74 are in each of the front and rear ends 38 and 42, respectively. In other embodiments, the vertical cutout 70 can be in only one of the front and rear ends.

The means for receiving the fastening means 22 further includes, in the base 62 of the floorboards 18, a cutout 78, a first opening or groove or recess 82 spaced from the extending generally parallel to the front end 38 of the floorboards 18, and a second opening or groove or recess 80 spaced from and extending generally parallel to the first groove 82 and the front end 38 of the floorboards 18.

As illustrated in FIGS. 1 and 2, the means 22 for fastening the floorboards 18 to the foundation 14 is in the form of a plurality of clips, with each of the clips 22 including a first generally horizontal upper portion 94 (see FIG. 1) received in the slot 74 in the front end 38 of the floorboards 18, a second generally horizontal upper portion 98 received in the slot 74 in the rear end 42 of the floorboards 18, a generally vertical portion 102 received in the cutouts 70, and a lower generally horizontal base portion 106 received in the cutout 78. In the particular embodiment shown, the first and second upper portions 94 and 98, respectively, are in the same plane, and the clips 22 are fabricated from flexible sixteen guage steel.

The clips 22 for fastening the floorboards 18 to the foundation 14 also include means 110 for effecting a positive engagement between each of the floorboards 18 and each of the clips 22. The means 110 is in the form of upwardly extending projection means connected to the base portion 106, spaced from the vertical portion 102, and received in the first and second grooves 82 and 86, respectively, in the base 62 of the floorboards 18. More particularly, in this embodiment, the projection means comprises two projections 114 and 118. The projection 114 is in the form of a bend in the base portion 106 of the clips 22, which bend forms a hump in the base portion 106 extending generally parallel to the vertical portion 102 of the clips 22. The hump 114 is received in the second groove 80 in the base 62 of the floorboards 18. The other projection 118 is provided by fasteners 122 for fastening the clips 22 to the foundation 14, which fasteners 122, in this particular embodiment, are in the form of nails driven into the base portion 106 of the clips 22 at regular intervals less than the width of the ends of the floorboards 18. Each nail 122 has a head which projects above the base portion 106 of the clips 22, and which serves as the second projection 118. The head 118 is received in the first groove 82 in the base 62 of the floorboards 18. The nails 122, hump 114, first and second grooves 82 and 86, respectively, cutouts 70 in the front and rear ends 38 and 42, respectively, and the base cutout 78, are located so that, when the floorboards 18 are received by the clips 22, the front and rear ends 38 and 42, respectively, of the floorboards 18, are flush with one another.

The hump 114 also acts as a stop which can be used with a spacer (not shown), such as the muzzle of a nail gun, for locating the nails 122 near the midpoint between the generally vertical portion 102 of the clips 22 and the outer edge of the base portion 106 of the clips 22. The bend or hump 114 also serves to add longitudinal strength to the clips 122 when the clips 22 are fabricated and when the clips 22 are fastened to the foundation 14.

After a course of parallel floorboards 18 is laid across a room, the clips 22 are laid end to end and the second generally horizontal upper portions 98 of the clips 22 are received in the slot 74 in the rear end 42 of the floorboards 18. The clips 22 are then fastened to the foundation 14 by the nails 122 spaced at regular intervals along the clips 22. The next course of parallel floorboards 18 is attached to the clips 22 one floorboard at a time by having the front end 38 of each floorboard slipped over the first upper portion 94 of the clip 22 and between the upper portion 94 and the base portion 106. When this is done, the clip 22 is slightly flexed so each floorboard 18 can be inserted into the clip 22 to the point where the nail heads 118 and hump 114 are received in the first and second grooves 82 and 86, respectively. Since the nail heads 118 and hump 114 are located to register with the first and second grooves 82 and 86, respectively, at the point where the front ends 38 and rear ends 42 come in contact, flush positioning of the courses of floorboards 18 is assured. Further, each of the following floorboards 18 to be laid can be connected to the clips 22 at a point spaced from the last floorboard, and then moved along the clips 22 to where the first side 30 of the floorboard is flush with the second side 34 of the prior floorboard.

After all of the courses of floorboards 18 are laid, the flooring system 10 may then be finished by attaching moldings 126 to the perimeter of the floorboards 18 to cover any perimeter voids.

Figure 4:
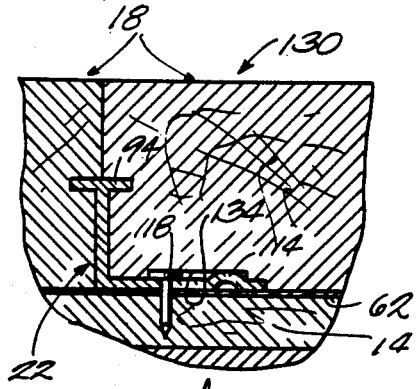
FIG. 4 is a cross-sectional view, similar to FIG. 2, of another flooring system which embodies various of the features of the invention.

In an alternate embodiment 130, as illustrated in FIG. 4, the base 62 of each of the floorboards 18 includes a single enlarged groove or recess 134 which receives both the hump 114 and the nail head 118. The enlarged groove 134 is sufficiently wide to permit reception of the hump 114 and the nail head 118, but narrow enough so that the floorboard 18 is held in place relative to the clips 22 by the hump 114 and the nail head 118.

Various of the features of the invention are set forth in the following claims.

I claim:

1. A flooring system comprising a foundation, a plurality of adjacent floorboards, each of said floorboards including a generally vertical side including a generally horizontal slot, and a base adjacent said foundation and including therein an opening spaced from said side, a clip including a generally horizontal upper portion received in said slot in one of said floorboards, a generally vertical portion, a lower generally horizontal base portion extending between said foundation and said base of said one floorboard, and a projection extending outwardly on said base portion, and a fastener in said base portion of said clip for securing said clip to said foundation, said fastener including a head projecting above said base position of said clip and received in said opening in said one of said floorboards.

2. A flooring system in accordance with claim 1 wherein said projection constitutes a bend in said base portion of said clip, which bend forms a vertically projecting hump which also extends horizontally generally parallel to said vertical portion of said clip.

3. A flooring system in accordance with claim 1 wherein said opening in said floorboard base comprises a groove extending generally parallel to said generally vertical side of said floorboard.

4. A flooring system in accordance with claim 1 wherein said floorboards each further include a second side opposite said first side, which second side includes a generally horizontal slot, and wherein said clip further includes a second generally horizontal upper portion extending in an opposite direction to said first generally horizontal upper portion and received in said second slot in said second side of another of said floorboards.

5. A flooring system in accordance with claim 1 wherein said floorboards each further includes a second opening located in said floorboard base and spaced from said side and spaced from said first opening, and wherein each of said clips further includes a second projection extending outwardly on said base portion and received in said second opening in said floorboard.

6. A flooring system in accordance with claim 1 wherein each of said clips further includes a second projection extending outwardly on said base portion and spaced from said first projection and received in said opening in said floorboard.

7. A flooring system comprising a foundation, a plurality of adjacent floorboards extending in serially adjacent parallel relationship to one another and each including a first generally vertical side including a generally horizontal slot, and a base adjacent to said foundation and including a first opening spaced from said generally vertical side of said floorboard, and a second opening spaced from said first opening and said generally vertical side of said floorboard, each of said floorboards further including a second side opposite said first side, which second side includes a generally horizontal slot, and a plurality of clips for fastening said floorboards to said foundation, each of said clips including a first generally horizontal upper portion received in said slot in said first side of one of said floorboards, a second generally horizontal upper portion received in said slot in said second side of another of said floorboards, and a generally vertical portion, a lower generally horizontal base portion extending between said foundation and said base of said one of said floorboards and including a first projection extending upwardly and received in said first opening in said base of said one of said floorboards, and a second projection extending upwardly and received in said second opening in said base of said one of said floorboards.

8. A flooring system in accordance with claim 7 wherein said first projection constitutes a bend in said base portion of said clip, which bend forms a vertically projecting hump which also extends horizontally generally parallel to said vertical portion of said clip, and wherein each of said clips further includes means for fastening said clip to said foundation and comprising a fastener in said base portion of said clip and including a head projecting above said base portion of said clip and constituting said second projection.

9. A flooring system in accordance with claim 7 wherein said first opening is a first groove extending generally parallel to said first side of said floorboard, and wherein said second opening is a second groove extending generally parallel to and spaced from said first groove and said first side of said floorboard.

10. A flooring system comprising a foundation, a plurality of adjacent floorboards extending in serially adjacent parallel relationship to one another and each of said floorboards including a first generally vertical side including a generally horizontal slot, and a base adjacent to said foundation and including an opening spaced from said generally vertical side of said floorboard, said floorboard further including a second side opposide said first side, which second side includes a generally horizontal slot, and a plurality of clips for fastening said floorboards to said foundation, each of said clips including a first generally horizontal upper portion received in said slot in said first side of one of said floorboards, a second generally horizontal upper portion received in said slot in said second side of another of said floorboards, a generally vertical portion, a lower generally horizontal base portion extending between said foundation and said base of said one of said floorboards and including a first projection extending upwardly and received in said opening in said base of said one of said floorboards, and a second projection extending upwardly in said base portion and spaced from said first projection and received in said opening in said base of said one of said floorboards.

11. A flooring system in accordance with claim 10 wherein said first projection constitutes a bend in said base portion of said clip, which bend forms a vertically projecting hump which also extends horizontally generally parallel to said vertical portion of said clip, and wherein each of said clips further includes means for fastening said clip to said foundation and comprising a fastener in said base portion of said clip and including a head projecting above said base portion of said clip, and constituting said second projection.

12. A flooring system in accordance with claim 10 wherein said opening is a groove extending generally parallel to said first side of said floorboard.

13. A flooring system comprising a foundation, a plurality of adjacent generally rectangular floorboards each including spaced ends having a first length and including a generally horizontal slot, spaced sides having a greater length than said first length, one of said sides including a groove and the other of said sides including a tongue adapted to interfit with a groove in an adjacent floorboard, and a base adjacent said foundation and including therein a recess spaced from one of said ends, and a clip including a generally horizontal upper portion received in said slot in one of said floorboards, a generally vertical portion, a lower generally horizontal base portion extending between said foundation and said base of said one floorboard, and a projection extending outwardly on said base portion and received in said recess in said one floorboard.

14. A flooring system in accordance with claim 13 wherein said floorboards each further includes a second recess located in said floorboard base and spaced from said side and spaced from said first mentioned recess, and wherein said clip further includes a second projection extending outwardly on said base portion and received in said second recess in said one floorboard.

15. A flooring system in accordance with claim 14 wherein said clip further includes a second projection extending outwardly on said base portion and spaced from said first projection and received in said recess in said one floorboard.

* * * * *